US006763534B2

(12) United States Patent
Hwang

(10) Patent No.: US 6,763,534 B2
(45) Date of Patent: Jul. 20, 2004

(54) ONE-TOUCH COLLAPSIBLE COT

(76) Inventor: Joo-Hwan Hwang, 595-17 Sincheon-Dong, Siheung-City, Kyonggi-Do (KR), 429-827

( * ) Notice: Subject to any disclaimer, the term of this patent is extended or adjusted under 35 U.S.C. 154(b) by 0 days.

(21) Appl. No.: 10/450,748

(22) PCT Filed: Nov. 28, 2001

(86) PCT No.: PCT/KR01/02055

§ 371 (c)(1),
(2), (4) Date: Jun. 16, 2003

(87) PCT Pub. No.: WO02/47515

PCT Pub. Date: Jun. 20, 2002

(65) Prior Publication Data

US 2004/0034929 A1 Feb. 26, 2004

(30) Foreign Application Priority Data

Dec. 15, 2000 (KR) ..... 2000/77017

(51) Int. Cl.[7] ..... A47C 17/64
(52) U.S. Cl. ..... 5/114; 5/110; 5/112
(58) Field of Search ..... 5/110–114

(56) References Cited

U.S. PATENT DOCUMENTS

D411,387 S * 6/1999 Zheng ..... D6/392
6,134,727 A * 10/2000 Hwang ..... 5/114

FOREIGN PATENT DOCUMENTS

| | | |
|---|---|---|
| KR | 95-6213 | 8/1995 |
| KR | 96-1441 | 2/1996 |
| KR | 00-63737 | 11/2000 |
| KR | 01-216373 | 3/2001 |

* cited by examiner

*Primary Examiner*—Teri Pham Luu
*Assistant Examiner*—Fredrick Conley
(74) *Attorney, Agent, or Firm*—Jordan and Hamburg LLP

(57) ABSTRACT

Disclosed herein is a one-touch collapsible cot. This one-touch collapsible cot includes a folding support frame (1) and a seat (50) held on the support frame (1). The support frame (1) is fabricated with a plurality of braces (3) cross-wisely jointed together by a plurality of joints (2), and has a head support brace (10), a leg support brace (20), a midsection support brace (30), and a tension projection (40). The seat (50) has a first brace pocket (60) for receiving the head support brace (10), a second brace pocket (70) for receiving the leg support brace (20), a wing (51) provided with a third brace pocket (80) for receiving the midsection support brace (30), and a locking hole (53) for receiving the tension projection (40) of the support frame (1). The seat (50) is quickly opened by the support frame (1) without leaving any uneven portion thereon.

3 Claims, 3 Drawing Sheets

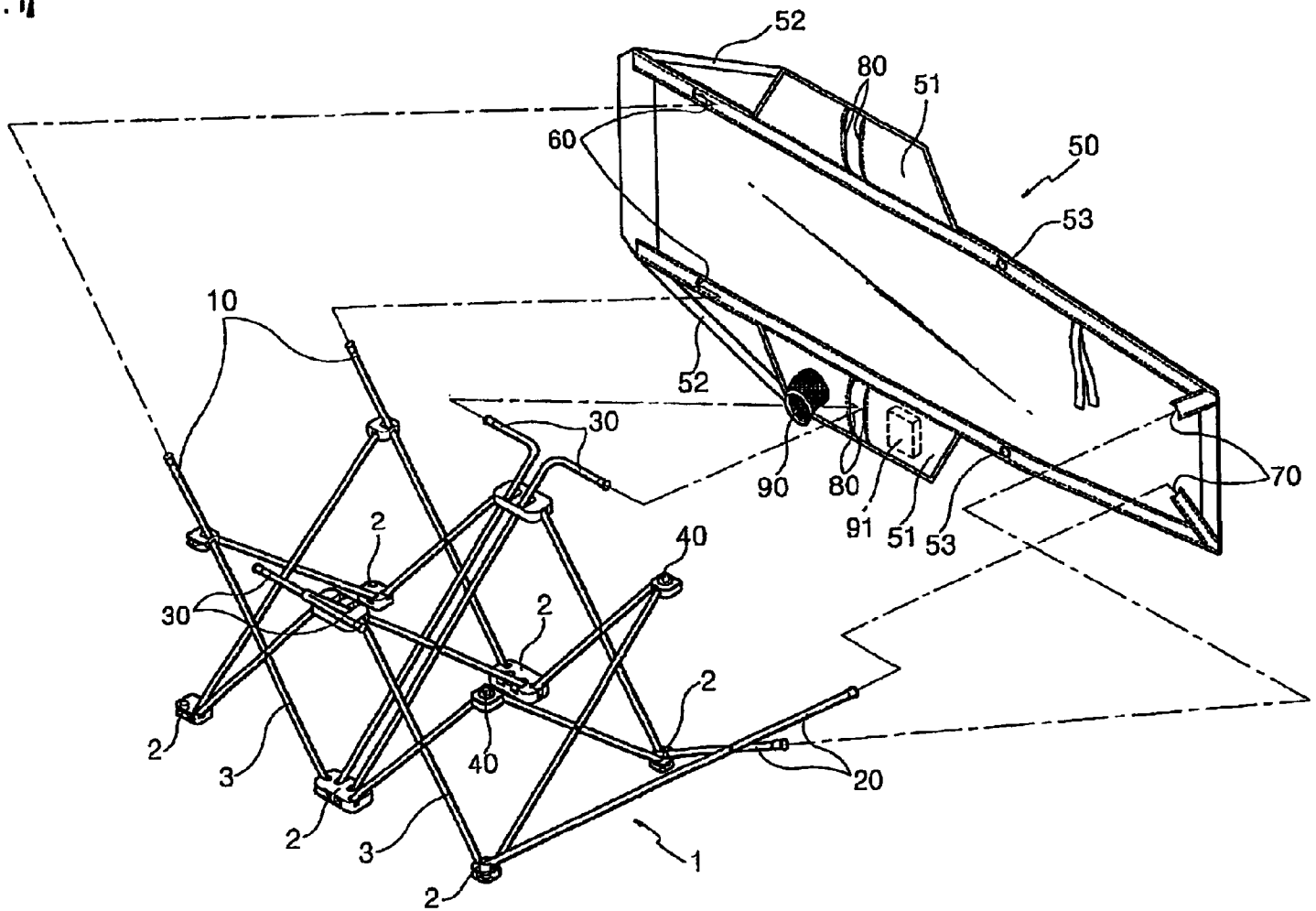
[FIG. 1]

【FIG.2】
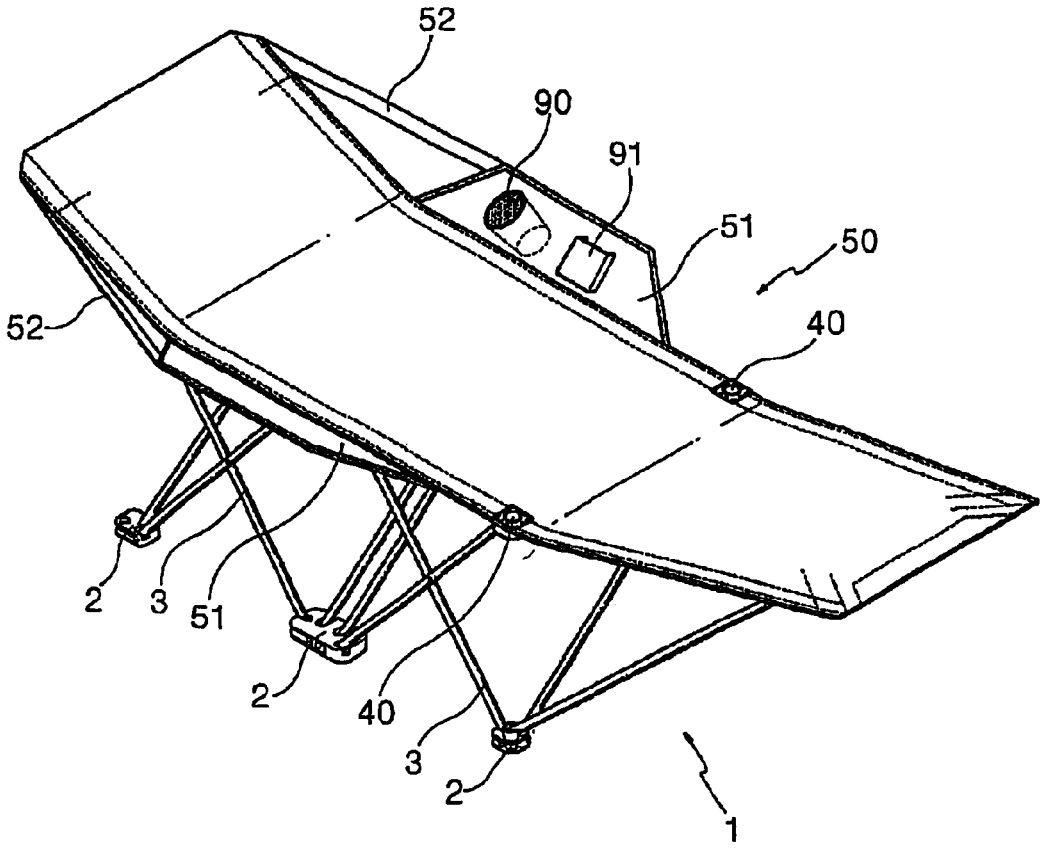

[FIG.3]
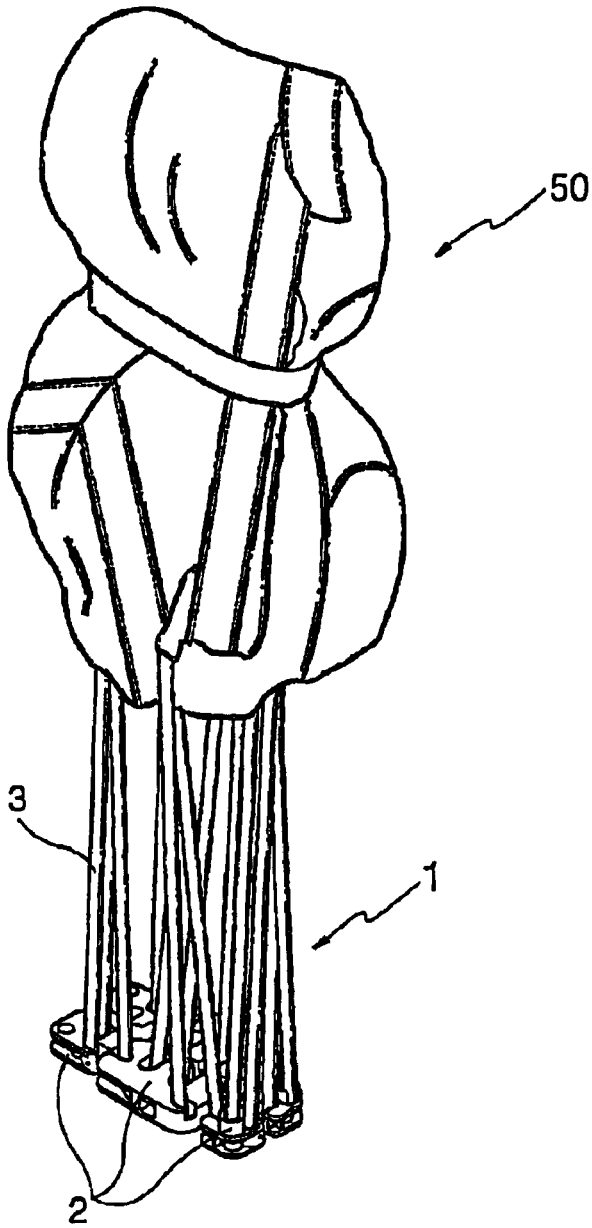

ONE-TOUCH COLLAPSIBLE COT

TECHNICAL FIELD

The present invention relates generally to a one-touch collapsible cot, and more particularly, to a one-touch collapsible cot, which is quickly opened and closed with a single operation while preventing its seat from being uneven when fully opened, thus being convenient to use as well as supporting a user's midsection comfortably, and being considerably improved in terms of both quality and reliability.

BACKGROUND ART

As well known to those skilled in the art, a collapsible cot is assembled in such a way as to be easily and quickly opened and closed, thus being convenient to be set up and put away, and being easy to be stored in a small space due to its compact and small size when closed, thereby being widely used for camping as well as other purposes.

Such conventional collapsible cots are disclosed in KR Utility Model Registration No. 94169 (Publication No. 95-6213) applied by the applicant of this invention, KR Utility Model Publication No. 96-1441 etc., and KR Patent Appln. No. 2000-44684.

However, the conventional collapsible cots have a problem that their seats may have an uneven portion thereon when opened, thus making a user's midsection uncomfortable, in addition to having a poor appearance.

The conventional cots have another problem that they are complicated to use, because several steps are required to close the cot for storage or open the cot for use.

The conventional cots have still another problem that they are inconvenient to use, because they have no pocket for storing a can or a bottle containing beverages and other personal belongings, such as cigarettes, a cellular phone, etc.

DISCLOSURE OF THE INVENTION

Accordingly, the present invention has been made keeping in mind the above problems occurring in the prior art, and an object of the present invention is to provide a one-touch collapsible cot, which is quickly opened and closed by a single operation, thereby being convenient to use.

Another object of the present invention is to provide a one-touch collapsible cot, the seat of which is even without leaving any uneven portion thereon when fully opened, thereby supporting a user's midsection comfortably.

A further object of the present invention is to provide a one-touch collapsible cot which has a good appearance, since its seat is even without leaving any uneven portion thereon when fully opened.

Still a further object of the invention is to provide a one-touch collapsible cot, which includes pockets for storing a can or a bottle containing beverages and other personal belongings, such as cigarettes, a cellular phone, etc., thereby being convenient to use.

An additional object of this invention is to provide a one-touch collapsible cot, which is considerably improved in terms of both quality and reliability.

In order to accomplish the above objects, the present invention provides a one-touch collapsible cot, which includes: a folding support frame fabricated with a plurality of braces crosswisely jointed together by a plurality of joints, and having: a head support brace extending upward and forward from a front joint to reach a position higher than a front brace; a leg support brace connected to a rear joint and extending upward and rearward to reach a position higher than a rear brace; a midsection support brace installed in the middle of the support frame at each side of the frame while being held by the middle joint of the frame and extending upward and outward to reach a position higher than a middle brace, and consisting of two arms bent outward at their outside ends to give a T-shaped profile to the midsection support brace; and a tension projection; and a seat held on the support frame and having: a first brace pocket formed on the lower surface of the front corner of the seat and receiving the head support brace; a second brace pocket formed on the lower surface of the rear corner of the seat and receiving the leg support brace; a wing provided at each side of the seat and having a third brace pocket formed on the lower surface of the wing for receiving the midsection support brace; and a locking hole for receiving said tension projection of the support frame, whereby the seat is quickly opened by the support frame without leaving any uneven portion thereon.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an exploded perspective view showing a one-touch collapsible cot according to the present invention;

FIG. 2 is a perspective view of the one-touch collapsible cot of this invention when it is fully opened in the assembled state; and FIG. 3 is a perspective view of the one-touch collapsible cot of this invention when it is fully closed.

BEST MODE FOR CARRYING OUT THE INVENTION

Reference now should be made to the drawings, in which the same reference numerals are used throughout the different drawings to designate the same or similar components.

As shown in the drawings, the one-touch collapsible cot of this invention includes a folding support frame 1 and a seat 50.

The support frame 1 is fabricated with a plurality of braces 3 crosswisely jointed together by a plurality of joints 2, and has two head support braces 10, two leg support braces 20, and two midsection support braces 30.

Each head support brace 10 extends upward and forward from a front joint 2 to reach a position higher than the front braces 3.

Each leg support brace 20 is connected to a rear joint 2 and extends upward and rearward to reach a position higher than the rear braces 3.

Each midsection support brace 30 is installed in the middle of the support frame 1 while being held by a middle joint 2 of the frame 1, and extends upward and outward to reach a position higher than the middle braces 3. Each midsection support brace 30 consists of two arms bent outward at their outside ends to give a T-shaped profile to the midsection support brace 30.

In the drawings, the reference numeral 50 denotes the seat held on the support frame 1. The seat 50 has two first brace pockets 60, two second brace pockets 70, and two wings 51 each provided with two third brace pockets 80.

The two first brace pockets 60 are formed on the lower surface of the opposite front corners of the seat 50 and receive the two head support braces 10. The two second brace pockets 70 are formed on the lower surface of the opposite rear corners of the seat 50 and receive the two leg support braces 20. The two wings 51 are provided at opposite sides of the seat 50. Each wing 51 is provided with two third brace pockets 80 formed on the lower surface of the wing 51 and receives the bent outside ends of a midsection support brace 30.

The one-touch collapsible cot of this invention also includes a tension band 52 connected to each corner of the front end of the seat 50 and an associated wing 51 at its opposite ends. Each wing 51 is provided with a net storage pocket 90 and a cloth storage pocket 91.

In the one-touch collapsible cot of this invention, two tension projections 40 are provided at predetermined positions of the support frame 1, whereas two locking holes 53 are provided at predetermined positions of the seat 50 for receiving the tension projections 40.

The operation of the one-touch collapsible cot of this invention will be described in the following.

First, as shown in FIG. 1, the tension projections 40 provided on the support frame 1 are received in the locking holes 53 and then locked to the holes 53 by means of additional locking members (not shown), so the seat 50 is held on the support frame 1. Thereafter, the two head support braces 10 of the support frame 1 are received in the first brace pockets 60 formed on the lower surface of the front corners of the seat 50. The two leg support braces 20 of the support frame 1 are received in the second brace pockets 70 formed on the lower surface of the rear corners of the seat 50. In addition, the two midsection support braces 30 installed in the middle of the support frame 1 are received in the third brace pockets 30 formed on the lower surface of the two wings 51. The assembly of the one-touch collapsible cot of this invention is thus quickly completed, as shown in FIG. 2 showing the fully opened collapsible cot.

When the one-touch collapsible cot of this invention is fully opened as shown in FIG. 2, this cot is more comfortable to use than conventional cots.

That is, according to the present invention, two midsection support braces 30 are received in the third brace pockets 80 of the two wings 51, and then stretched in all directions as the support frame 1 is opened. At this time, the two midsection support braces 30 held in the third brace pockets 80 strain the wings 51, and the wings 51 stretch the seat 50, so the seat 50 becomes smooth without leaving any uneven portion thereon. In addition, when the user lies down on the opened seat 50, the tension band 52 connected to each corner of the end of the seat 50 and the associated wing 51 at its opposite ends tensions the wing 51 diagonally, so the seat 50 is kept smooth without leaving any uneven portion thereon, thereby supporting the user's midsection comfortably.

The wing 51 is provided with a net storage pocket 90 and a cloth storage pocket 91, thereby being more convenient to use.

That is, when the user drinks a beverage or alcoholic liquor while using the cot, a can or a bottle of beverage may be temporarily stored in the net storage pocket 90, thereby being convenient to use. In addition, a purse or a cellular phone of the user may be stored in the cloth storage pocket 91, so preventing the user's belongings from being lost.

The cot of this invention is quickly opened and closed with a single operation, thereby being more convenient to use.

When it is desired to fully close the cot as shown in FIG. 3, the user holds the opposite sides of the cot and pushes them inward in such a way that one side of the cot is in contact with the other side. Thus, the braces 3 crosswisely jointed together by the joints are closed around the joints, and then the support frame 1 is folded, as shown in FIG. 3, thereby quickly closing the cot with a single operation.

When it is desired to fully open the cot for use, the user may open the cot by performing in reverse order of the operation of closing the cot. That is, the user holds the opposite sides of the cot and pulls them outward. Thus, the support frame 1 is opened, thereby quickly opening the cot with a single operation.

Industrial Applicability

As described above, the present invention provides a one-touch collapsible cot, which is opened and closed with a single operation, thereby being convenient to use. The collapsible cot is smooth without leaving any uneven portion on its seat when fully opened, thereby supporting a user's midsection comfortably as well as having a good appearance. This collapsible cot also includes pockets for storing a can or a bottle containing beverage and other personal belongings, such as cigarettes, a cellular phone, etc., thereby being convenient to use. The collapsible cot of this invention is improved in terms of both quality and reliability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A one-touch collapsible cot, comprising:

a folding support frame fabricated with a plurality of braces crosswisely jointed together by a plurality of joints, said support frame comprising:

a head support brace extending upward and forward from a front joint to reach a position higher than a front brace;

a leg support brace connected to a rear joint and extending upward and rearward to reach a position higher than a rear brace;

a midsection support brace installed in a middle of the support frame at each side of the frame while being held by a middle joint of the frame and extending upward and outward to reach a position higher than a middle brace, said midsection support brace consisting of two arms bent outward at their outside ends to give a T-shaped profile to the midsection support brace; and a tension projection provided at a predetermined position of the support frame; and a seat held on said support frame, and comprising:

a first brace pocket formed on a lower surface of a front corner of said seat and receiving the head support brace;

a second brace pocket formed on a lower surface of a rear corner of said seat and receiving the leg support brace;

a wing provided at each side of said seat, with a third brace pocket formed on a lower surface of the wing for receiving the midsection support brace; and a locking hole formed on the seat at a predetermined position and receiving said tension projection of the support frame, whereby the seat is quickly opened by the support frame without leaving any uneven portion thereon.

2. The one-touch collapsible cot according to claim 1, further comprising a tension band connected to each corner of an end of said seat and an associated wing at its opposite ends.

3. The one-touch collapsible cot according to claim 1, wherein said wing is provided with a net storage pocket and a cloth storage pocket.

* * * * *